United States Patent [19]

Finke et al.

[11] Patent Number: 4,661,662

[45] Date of Patent: Apr. 28, 1987

[54] POWER LINE WORKING APPARATUS

[75] Inventors: Ronald J. Finke; Victor J. Mullen; Danny R. Williams; Robert J. Morris; Charles E. Tucker, all of Houston, Tex.

[73] Assignee: Houston Industries, Incorporated, Houston, Tex.

[21] Appl. No.: 782,378

[22] Filed: Sep. 30, 1985

[51] Int. Cl.[4] ..... H01H 31/00

[52] U.S. Cl. ..... 200/48 R; 200/146 R; 200/49

[58] Field of Search ..... 200/146 R, 48 R, 49, 200/48 CB, 48 SB

[56] References Cited

U.S. PATENT DOCUMENTS 3,274,364 9/1966 Sullivan et al. ..... 200/48 R
3,838,364 9/1974 Bridges ..... 200/48 R

FOREIGN PATENT DOCUMENTS 120945 2/1948 Switzerland ..... 200/49

*Primary Examiner*—Robert S. Macon
*Attorney, Agent, or Firm*—Pravel, Gambrell, Hewitt & Kimball

[57] ABSTRACT

A new and improved apparatus is provided to permit a live or hot electrical power line to be cut in the field for line service or other purposes. The apparatus is connected at each end to the line at positions spanning the site of the cut. The attached end portions are then moved closer to each other, easing the tension on the portion of the line to be cut. The apparatus is then connected to the live line with jumper cables, forming a parallel electric circuit. The line is then cut and a cut end tied back. Flow of current through the apparatus is broken. An interrupter in the apparatus suppresses any arc which may tend to form.

16 Claims, 7 Drawing Figures

POWER LINE WORKING APPARATUS

BACKGROUND OF THE INVENTION

1. FIELD OF INVENTION

The present invention relates to apparatus for working on line electrical power lines.

2. DESCRIPTION OF PRIOR ART

In the electrical power industry, it is often necessary to cut or interrupt a live high power line for service or other purposes. These lines usually carry high voltage electrical power, often with voltages of thirty kilovolts or higher. Further, it was usually required to cut the line at a position located away from any support pole or tower.

U.S. Pat. No. 3,205,330 related to an electrical circuit interrupter switch for interrupting high power electrical circuits. However, so far as is known, this type of interrupter switch was apparently limited to use in areas where it could be suspended or supported beneath poles or towers.

Prior practice in other areas was to simply cut the live line using a cutter at the end of a long insulating rod. This was undesirable, in that hazardous arcs occurred, often following the cut end of the line to the ground.

SUMMARY OF INVENTION

Briefly, the present invention provides a new and improved power line working apparatus and method for permitting a live electrical power line to be cut. Mounting grips are connected to the line at first and second positions adjacent a section of the line to be cut. The mounting grips are connected at opposite ends of an elongate support rod, which is preferably formed from a highly insulative material. The mounting grips are then moved closer to each other by a movement mechanism associated with the support rod to increase tension in the section of the line to be cut. Conductive stirrups and a conductive bar are mounted with the support rod to form, when connected by cables to the line, a parallel electrical circuit with the portion of the line to be cut. Once the line has been cut, and preferably after at least one end has been tied back, the parallel electrical circuit is broken or interrupted by moving the position of the conductive bar with respect to the stirrups. An arc interrupter is engaged as the conductive bar moves to suppress any arc formed as the parallel electrical circuit is broken.

DESCRIPTION OF PREFERRED EMBODIMENT

Figure 1:
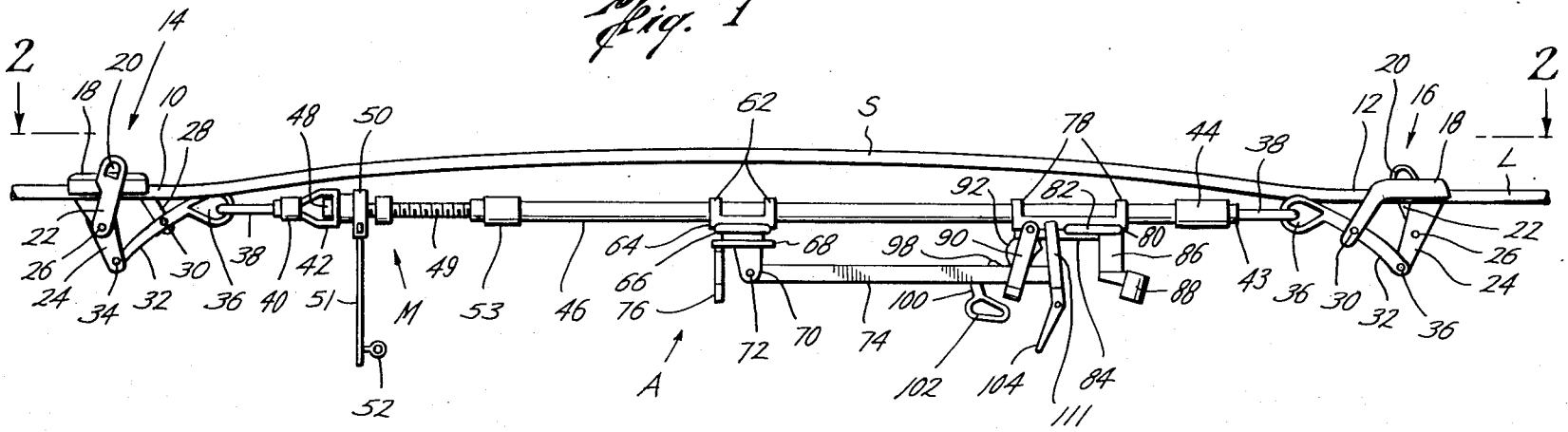
FIG. 1 is an elevation view of an apparatus according to the present invention.

In the drawings, the letter A designates generally an apparatus according to the present invention for working on a power line L, permitting the line L to be cut at locations away from poles, towers or other support structures while line L is live or carrying electrical power therethrough. The line L with which the apparatus A is used typically carries substantially high levels of electrical power, such as at voltages exceeding thirty kilovolts.

The apparatus A is mounted to the line L at a first position 10 and a second position 12 adjacent a section S of the line L to be cut by line grips 14 and 16. Line grips 14 and 16 are of the conventional type and are of like construction. The position of line grip 14 on the line L is reversed from that of line grip 16. Each of line grips 14 and 16 has a generally U-shaped mounting saddle 18 which fits over the line L for support purposes. An eyelet 20 is formed at an upper end of a mounting arm 22 to receive manipulating hooks of the conventional type which are mounted at the end of extended insulated operator poles. A jaw arm 24 of the conventional type having a gripper jaw formed at an upper portion thereof for gripping the line L is pivotally mounted at a pivot point 26 to the arm 22. An arm 28 is formed extending downwardly from the saddle 18 and has a pivoted connection 30 with a lever arm 32. The lever arm 32 is further pivotally connected at a pivot point 34 to the jaw arm 24. An eyelet 36 is formed on the lever arm 32 at an opposite end from the pivot 34 to permit a manipulator hook to be inserted and move the lever arm 32 to move the jaw on the jaw arm 24 into firm engagement with the line L beneath the saddle 18.

Swiveled connector hooks 38 are mounted in the eyelets 36 of the line grips 14 and 16 to connect the apparatus A to the line L adjacent positions 12 and 14. In one embodiment of the present invention, a first of the connector hooks 38 is mounted in a swivel housing 40 to a mounting yoke 42 of a line tensioning mechanism M of the apparatus A. The other of the connector swivel hooks 38 is mounted in a swivel housing 43 to an end socket member 44 at one end of an elongate insulative support rod 46. It should be understood, however, that movement mechanisms M may be mounted according to the present invention at each end of the support rod 46, if desired. The rod 46 is formed from a suitable insulative material, such as fiberglass, and is hollow along at least a portion adjacent movement mechanism or mechanisms M, for reasons to be set forth. The rod 46 may be tubular in form, if desired.

A mounting nut 48 at an end of a threaded rod 49 of the mechanism M mounts the mechanism M to the yoke 42. A ratchet mechanism 50 is mounted with the yoke 42 and receives the threaded rod 49 therein. The ratchet mechanism 50 is driven by a ratchet arm 51 which is manipulated by means of manipulator hooks inserted into a swivel eyelet 52 at a lower end of the ratchet arm 51. As the ratchet arm 51 is moved, ratchet mechanism 50 causes the threaded rod 49 to move inwardly or outwardly, depending upon the setting of the ratchet mechanism 50, into a threaded end socket 53 at an end of the rod 46. The rod 46 is hollow in its interior portions at such end, forming a tubular receiving member for receiving the advancing end of the threaded rod 49 as it is moved by the ratchet mechanism 50. A stop nut 54 is mounted on the threaded rod 49 to limit the inward advance of the threaded rod 49 into the end socket 53 of the rod 46.

Figure 2:
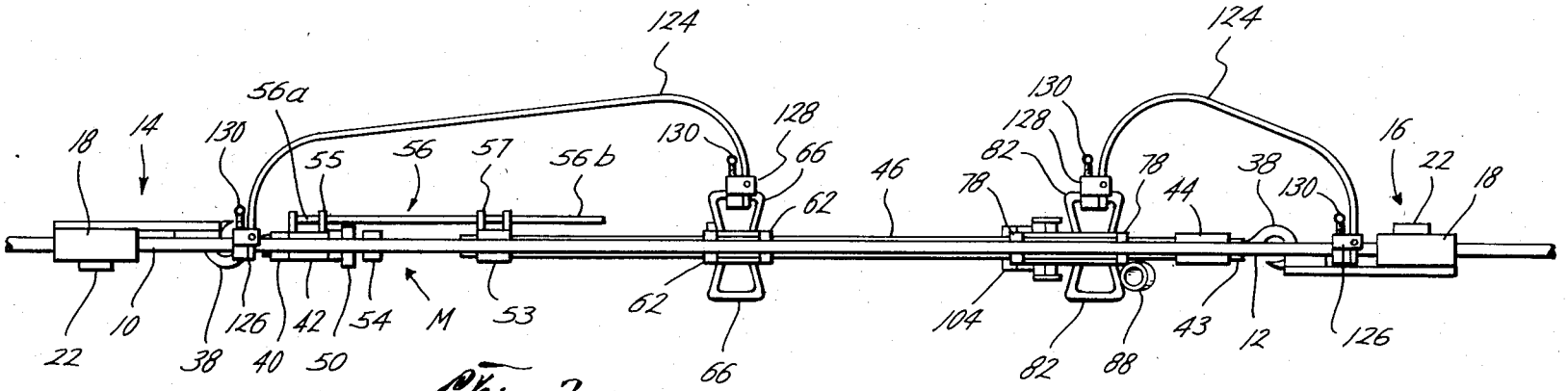
FIG. 2 is a view taken along the lines 2—2 of FIG. 1.

A connector mounting bracket 55 (FIG. 2) is mounted with the yoke 42 adjacent the mechanism M and has fixedly mounted therein a first end 56*a* of a connector rod 56. The connector rod 56 moves in correspondence with the threaded rod 49 and a second end 56*b* of connector rod 56 slides within a mounting bracket 57 which is fixedly mounted to the end socket 53 of the rod 46.

Tubular mounting collars 62 are formed extending upwardly from a channel member 64 to receive the rod 46 therein. The channel member 64 is formed from a suitably conductive material, such as aluminum or the like, and has outwardly extending conductive stirrups 66 formed thereon. The conductive stirrups 66 extend sidewardly from a conductive plate or bracket member 68. Downwardly extending conductive spaced side jaws or lugs 70 formed beneath the plate 68. The spaced jaws 70 have a pivotal connection 72 to receive a movable conductive bar 74, formed from copper or other suitable conductive material, therebetween. A support latch spring member 76 is mounted beneath the plate 68 to support the bar 74, as will be set forth.

Figure 3:
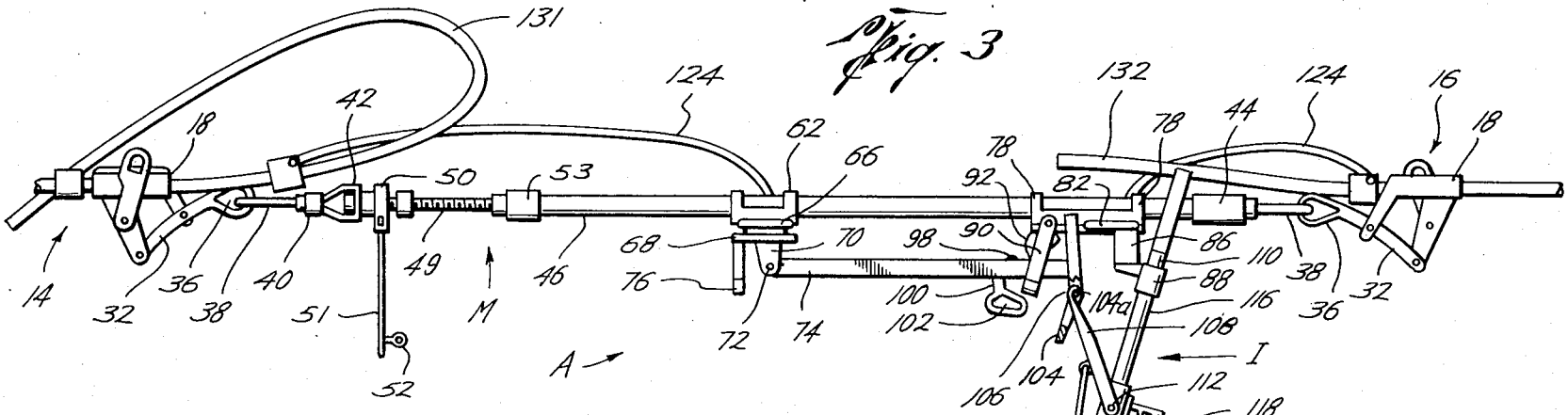
FIGS. 3, 4, 5 and 6 are elevation views of portions of the apparatus of FIG. 1 in different positions during power line working operations.

Cylindrical mounting collars 78 are formed at each end of a channel member 80 and receive the rod 46 therein. Conductive stirrups 82 are formed extending sidewardly from a conductive bracket 84 beneath the channel 80. An arm 86 is formed extending downwardly from the bracket 84 and has a mounting sleeve 88 formed thereon for receiving an interrupter I (FIG. 3). Resilient conductive switch jaws 90 are formed extending downwardly on each side of the bar 74 from the bracket 84 to firmly hold the bar 74 in place. A releasable latch mechanism 92 is mounted with the bracket 84 to engage a lug 98 mounted extending above a side portion of the bar 74. The lug 98 engages the releasable latch mechanism 92 to hold the bar 74 in place connecting the conductive stirrups 66 and 82. The lug 98 forms an upper portion of an arm member 100 which has a pull grip 102 formed at a lower portion thereof.

A generally U-shaped contact yoke 104 is formed at an end 74*a* of the bar 74. The yoke 104 has a rod 104*a* (FIG. 3) formed extending across an upper portion which is adapted to engage a hook 106 formed at an upper end of a latch lever 108 of the interrupter I (FIG. 3). A dielectric plate 110 is formed extending upwardly from the yoke 104, having a suitably shaped center notch at its upper surface for engaging the channel member 80 (FIG. 3).

The interrupter I is of a conventional type, such as of the type disclosed in U.S. Pat. No. 3,205,330. The interrupter I is connected by a connector mechanism 110 to the mounting sleeve 88 beneath the bracket 84. The latch lever 108 of the interrupter I is pivotally mounted at a pivot mechanism 112 to a latch ferrule 114 mounted about an interrupter body 116. Contained within the interrupter body 116 is structure, including arc extinguishing material, of the type disclosed in U.S. Pat. No. 3,205,330, which is incorporated herein by reference. An eyelet 118 is formed on a member extending outwardly from the ferrule 114 to permit manipulation of the interrupter I by manipulator mechanisms. A connector rod 120 is pivotally mounted at an upper end to the latch lever 108 and at a lower end to a pivot joint 122 mounted beneath the interrupter body 116.

Jumper cables 124 extend between line clamps 126 and 128 at each end of the apparatus A. The line clamps 126 and 128 are conventional, gripping the line L with increased force at an eyelet 130 formed therewith is tightened by a manipulating rod. The line clamps 128 at a second end of the jumper cables 124 are adapted to be tightened in a like manner onto the stirrups 66 and 82 of the apparatus A, permitting a parallel electrical circuit to be formed through the apparatus A from the line clamps 126 through the jumper cables 124, line clamps 128, stirrups 66 and 82 and the brackets 68 and 84 through the conductive bar 74 with the apparatus A in the position shown in FIG. 1.

In the operation of the present invention, the line grips 14 and 16 (FIGS. 1 and 2) are hung on the line L at the positions 10 and 12 adjacent the section S of the line L to be cut. The apparatus A is then attached to the connector eyelets 36 of the line grips 14 and 16 by connector hooks 38. The ratchet mechanism M is then operated, by movement of the ratchet arm 56 to drive the threaded rod 49 inwardly into the threaded end sleeve 58 of the rod 46, bringing the line grips 14 and 16 closer towards each other, easing tension and placing slack in the section S of the line to be cut. Jumper cables 124 are then attached between the line L and the stirrups 66 and 82, forming a parallel electrical circuit arrangement through the apparatus A with the line L.

The interrupter I is then installed (FIG. 3) in the sleeve 88 of the apparatus A. At this time, it is often desirable to test open the interrupter I with the section S of the line L still intact as a safety check to insure that the apparatus A is operating satisfactorily. If the apparatus A tests satisfactorily, the section S of the line L is then cut by a conventional line cutting tool. An end 131 of the cut line is then brought backwards and tied back so that it is maintained out of proximity with an opposite end 132 of the cut line L.

Figure 4:
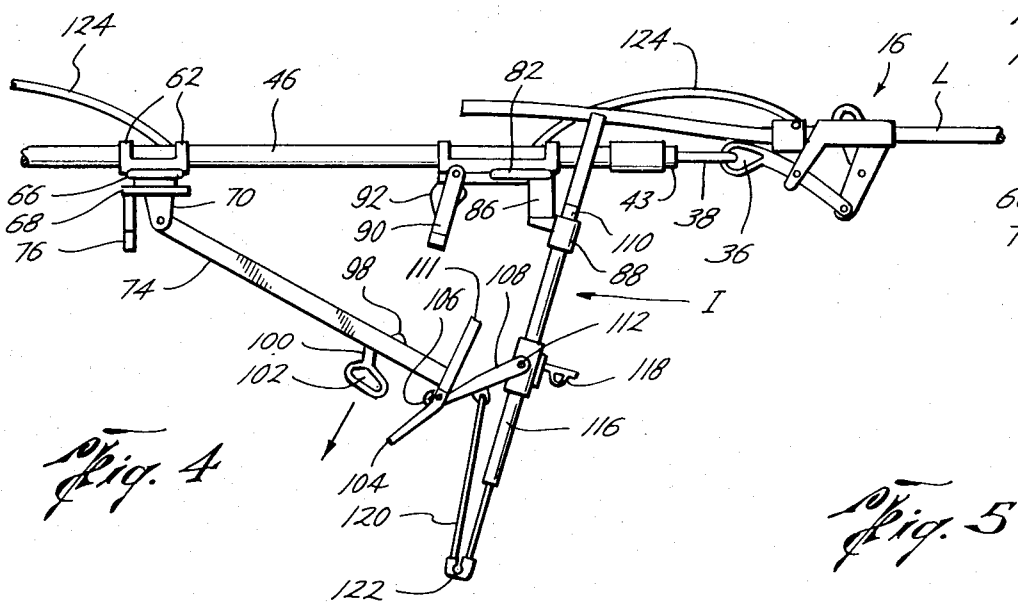

The pull grip 102 of the apparatus A is then pulled downwardly (FIGS. 3 and 4), moving the bar 74 out of contact with the switch jaws 90. However, a conductive path still exists as the bar 74 moves downwardly due to the contact between the rod 104*a* of the yoke 104 with the hook 106 of the latch lever 108. This electrical connection is maintained during downward movement of the bar 74 until a point is reached (FIG. 4) wherein the interrupter I internally breaks electrical connection between the end portions 131 and 132 of the line L, with the contents of the interrupter body 116 suppressing any arc which might tend to be formed on breaking of the electrical connection.

Figure 5:
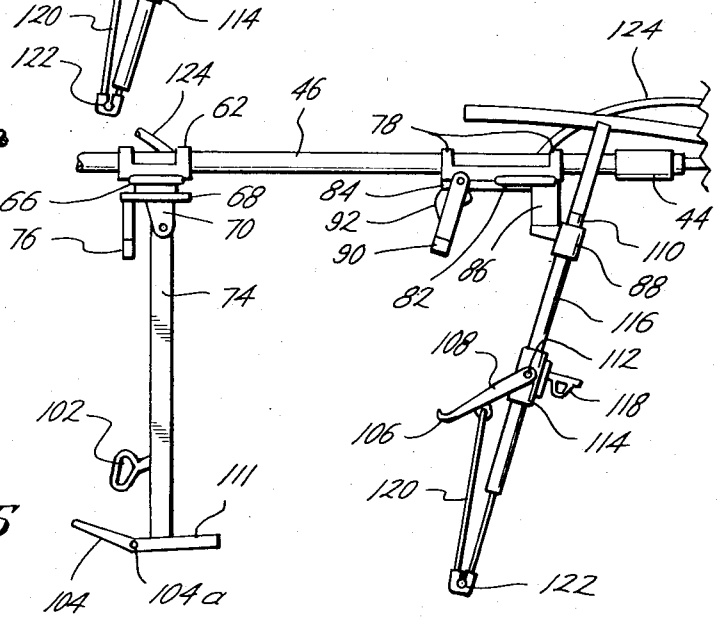
Figure 6:
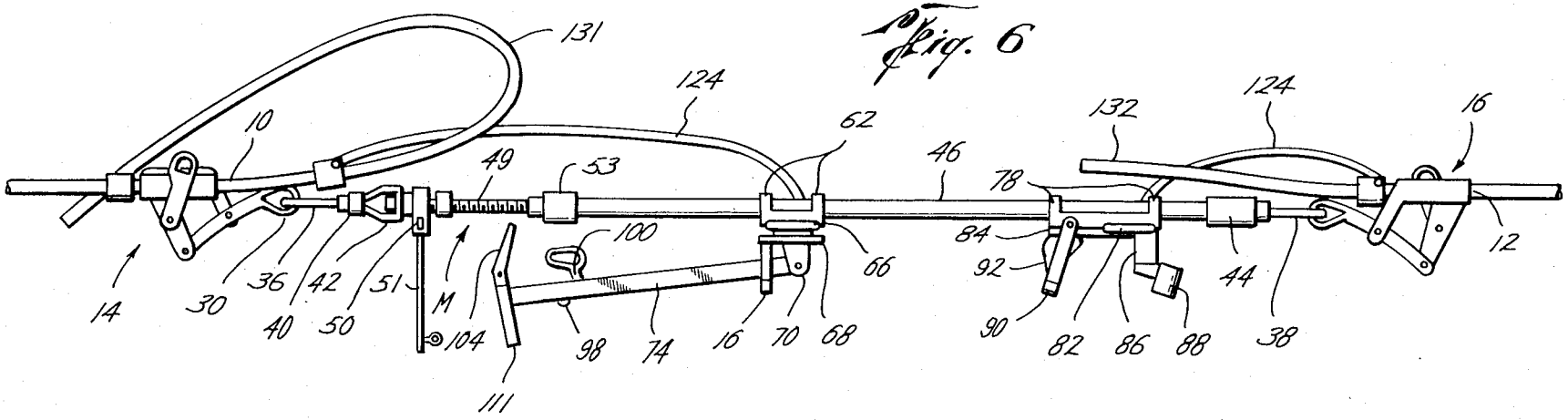

The bar 74 swings downwardly of its own weight until it reaches a nearly vertically extending position (FIG. 5). At this time, it may again be engaged at pull grip 102 and moved upwardly until it is contacted with support latch spring 76 (FIG. 6) to hold the conductive rod 74 at a spaced position from the cut end portion 132 of the line L. The interrupter I may at this time also be removed to gain space for working operations.

Figure 7:
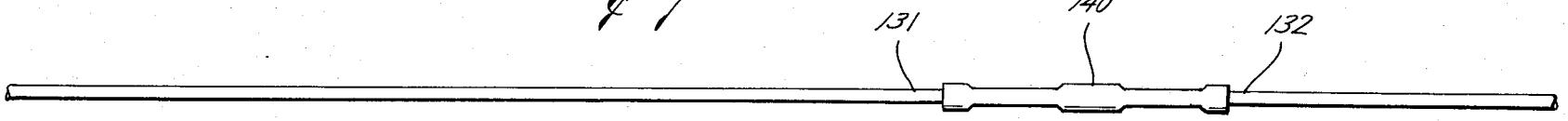
FIG. 7 is an elevation view of a spliced power line after power line working operations according to the present invention are completed.

After the working operations on the cut line L have been completed, the conductive rod 74 is removed from engagement with the support latch spring 76 and pivoted by means of pull grip 102 back into contact with the switch jaws 90. This can usually be done fairly quickly and there is little, if any, risk of an arc being formed at this time. For additional arc suppression protection, the interrupter I may be reinserted in the sleeve 88 of the apparatus A prior to this time and used to suppress any arc which might possibly be formed. At this time, with the bar 74 engaged between the switch jaws 90, the flow of electrical current through the line L resumes. The end portion 131 of the cut line L is then released from its tied back position and brought into position near the other cut end portion 132 and a conventional electrical cable splicing sleeve 140 (FIG. 7) inserted over the end portions 131 and 132. The splicing sleeve 140 is then crimped down to electrically connect the end portions 131 and 132 of the apparatus A to each other. The jumper cables 128 are then removed, electrically disconnecting the apparatus A from the line L. The apparatus A is then mechanically disconnected from the line L by disengaging swivel hooks 38 from the eyelets 36 of the line grips 14 and 16, and then removing the line grips 14 and 16.

The foregoing disclosure and description of the invention are illustrative and explanatory thereof, and various changes in the size, shape and materials, as well as in the details of the illustrated construction may be made without departing from the spirit of the invention.

We claim:

1. An apparatus for permitting a live electrical power line to be cut, comprising:

(a) mounting means for connecting to the line at a first and a second position adjacent a section of the line to be cut;

(b) means for moving said mounting means closer to each other once connected to ease tension on the section of the line to be cut;

(c) means for connection in a parallel electrical circuit with the section of the line to be cut; and (d) means for breaking said parallel electrical circuit once the line has been cut.

2. The apparatus of claim 1, further including:

means for suppressing any arc formed in said means for breaking said parallel electrical circuit.

3. The apparatus of claim 1, wherein said mounting means comprises:

means for connecting to the line at first and second positions spanning the portion to be cut.

4. The apparatus of claim 1, wherein said mounting means comprises:

line grip means.

5. The apparatus of claim 1, wherein said means for moving comprises:

(a) an elongate insulative support rod;

(b) connector means at opposite ends of said rod for connection to said mounting means;

(c) means for adjusting the relative position of said connector means with respect to said rod.

6. The apparatus of claim 5, wherein said means for adjusting comprises:

a ratchet mechanism mounted with at least one of said connector means.

7. The apparatus of claim 6, wherein said means for adjusting comprises:

a threaded member driven by said ratchet mechanism for movement into and out of a socket formed in an end of said rod.

8. The apparatus of claim 1, wherein said means for connection comprises:

(a) plural conductive stirrup means mounted at spaced positions from each other on said means for moving;

(b) jumper cable means for electrically connecting said mounting means to said plural conductive stirrup means; and (c) a conductive bar extending between said plural conductive stirrup means.

9. The apparatus of claim 8, wherein said means for breaking comprises:

means for permitting relative movement of said conductive bar with respect to said plural conductive stirrup means.

10. The apparatus of claim 8, wherein said means for breaking comprises:

means for releasably engaging said conductive bar between said plural conductive stirrup means.

11. The apparatus of claim 8, further including:

means for holding said conductive bar in a spaced position from at least one of said conductive stirrup means once the line has been cut.

12. A method of cutting a live electrical power line, comprising the steps of:

(a) attaching to the line at spaced positions adjacent a section of the line to be cut;

(b) moving the spaced positions of the line together to ease tension in the line;

(c) forming a parallel electrical circuit with the section of the line;

(d) cutting the section of the line;

(e) breaking the parallel circuit after the line is cut.

13. The method of claim 12, further including the step of:

suppressing any arc formed during said step of breaking the parallel circuit.

14. The method of claim 12, further including the step of:

tying back at least one cut end of the line.

15. The method of claim 12, further including the step of:

forming a conductive electrical circuit between the cut ends of the line.

16. The method of claim 15, further including the step of:

joining the cut ends of the line together after the conductive electrical circuit is formed therebetween.

* * * * *